US008292319B2

(12) United States Patent
Dykema

(10) Patent No.: US 8,292,319 B2
(45) **Date of Patent: *Oct. 23, 2012**

(54) SKATEBOARD DECK

(76) Inventor: Robert A. Dykema, La Mesa, CA (US)

( * ) Notice: Subject to any disclaimer, the term of this patent is extended or adjusted under 35 U.S.C. 154(b) by 226 days.

This patent is subject to a terminal disclaimer.

(21) Appl. No.: 12/715,696

(22) Filed: Mar. 2, 2010

(65) Prior Publication Data

US 2010/0148462 A1 Jun. 17, 2010

Related U.S. Application Data

(63) Continuation of application No. 11/681,924, filed on Mar. 5, 2007, now Pat. No. 7,669,879.

(51) Int. Cl.
*A63C 5/04* (2006.01)

(52) U.S. Cl. ..... 280/609; 280/601

(58) Field of Classification Search ..... 280/609, 280/601, 610, 608, 604, 18; 441/74, 68
See application file for complete search history.

(56) References Cited

U.S. PATENT DOCUMENTS

| | | | | |
|---|---|---|---|---|
| 2,499,959 | A | 3/1950 | Kruse et al. | |
| 3,378,274 | A | 4/1968 | Poppen | |
| 3,381,972 | A | 5/1968 | Miller | |
| 4,029,330 | A | 6/1977 | Runyan, Jr. | |
| 4,061,350 | A | 12/1977 | Schmidt, Jr. et al. | |
| 4,223,909 | A | 9/1980 | Danner et al. | |
| 4,234,204 | A | 11/1980 | Tibbals | |
| D261,544 | S | 10/1981 | Cramer | |
| 4,337,963 | A | 7/1982 | Stevenson | |
| 5,167,552 | A | 12/1992 | Johnson, III | |
| 5,238,434 | A | 8/1993 | Moran | |
| 5,328,200 | A | 7/1994 | Pelizzari | |
| 5,725,237 | A * | 3/1998 | Krafft et al. | 280/609 |
| 6,059,307 | A | 5/2000 | Western | |
| 6,182,986 | B1 | 2/2001 | Smith | |
| 6,290,249 | B1 | 9/2001 | Wolf | |
| 6,386,561 | B1 | 5/2002 | Hanson | |
| 6,460,868 | B2 | 10/2002 | Madrid | |
| 6,854,748 | B2 | 2/2005 | Wimbish et al. | |
| 7,077,418 | B2 | 7/2006 | Heftberger et al. | |
| 7,213,828 | B2 | 5/2007 | Riepler et al. | |
| 7,216,887 | B2 | 5/2007 | Riepler | |
| 7,422,228 | B2 * | 9/2008 | Cheung | 280/609 |

(Continued)

FOREIGN PATENT DOCUMENTS

KR 10-2002-21200 3/2002

(Continued)

OTHER PUBLICATIONS

International Search Report and Written Opinion from PCT/US08/55517 issued Jul. 17, 2008, 11 pages.

*Primary Examiner* — Hau Phan
(74) *Attorney, Agent, or Firm* — Stephen C. Beuerle; Procopio Cory Hargreaves & Savitch LLP

(57) ABSTRACT

A high-strength skateboard deck includes an elongated body having opposite ends, opposite sides, an upper side and a lower side, the lower side including a plurality of embossments therein, improving the strength in the skateboard deck, reducing fatigue in the skateboard deck, and reducing the coefficient of friction of the lower side of the skateboard deck.

18 Claims, 3 Drawing Sheets

U.S. PATENT DOCUMENTS

| | | | | |
|---|---|---|---|---|
| 7,669,879 | B2 * | 3/2010 | Dykema | 280/609 |
| 2003/0094787 | A1 | 5/2003 | Riepler et al. | |
| 2003/0151215 | A1 | 8/2003 | Stief et al. | |
| 2004/0183269 | A1 | 9/2004 | Hadzicki et al. | |
| 2004/0222609 | A1 | 11/2004 | Schmitt | |
| 2005/0230931 | A1 | 10/2005 | Chen | |

FOREIGN PATENT DOCUMENTS

| | | |
|---|---|---|
| WO | WO 87/01297 | 3/1987 |

* cited by examiner

SKATEBOARD DECK

CROSS REFERENCE TO RELATED APPLICATION

This application is a continuation of U.S. patent application Ser. No. 11/681,924, filed Mar. 5, 2007, which issued as U.S. Pat. No. 7,669,879 on Mar. 2, 2010. U.S. patent application Ser. No. 11/681,924 is incorporated by reference herein.

FIELD OF THE INVENTION

The present invention relates to skateboard decks and methods of manufacturing skateboard decks.

BACKGROUND OF THE INVENTION

Skateboarders typically like to do tricks and jumps using their skateboards. Skateboarding tricks and jumps put the skateboard deck under a lot of stress. This prolonged stress on the skateboard deck over time causes fatigue in the skateboard deck. The skateboard deck loses its rigidity and becomes flexible. Eventually the skateboard deck can break. A broken skateboard deck is dangerous because the skateboarder can become seriously injured during a trick or jump if the board breaks during the trick or jump. Further, a broken skateboard deck requires repair or replacement, which can be expensive.

Another problem with skateboard decks is that during sliding tricks and maneuvers (i.e., where the lower side of the skateboard deck slides along a rail or edge), the lower side of current skateboard decks provide a high coefficient of friction with the rail or edge. As a result, much of the energy that goes into a sliding trick and maneuver is absorbed as friction in the bottom of the lower side of the skateboard deck and in the rail or edge. This friction inhibits the distance of travel of the skateboard deck along the rail or edge, and the rider has to come out of the sliding trick and maneuver early.

Thus, a need exists for a stronger skateboard deck that does not break during tricks or jumps, and remains rigid and does not fatigue over time.

Another need exists for a skateboard deck that includes an lower side that has a reduced coefficient of friction compared to skateboard decks in the past, allowing a rider to slide longer distances along the lower side of the skateboard deck during sliding tricks and maneuvers.

A further need exists for a manufacturing method for producing higher-strength skateboard decks that remain rigid and do not fatigue over time.

A still further need exists for a manufacturing method for producing higher-strength skateboard decks that produces more skateboard decks in a given period of time than was done in the past.

SUMMARY OF THE INVENTION

Accordingly, an aspect of the invention involves a high-strength skateboard deck including an elongated body having opposite ends, opposite sides, an upper side and a lower side, the lower side including a plurality of embossments therein, improving the strength and reducing fatigue in the skateboard deck so that the skateboard deck retains its rigidity and does not break during tricks or jumps. The embossments in the lower side also reduce the coefficient of friction in the lower side compared to a lower side without the embossments. This allows a rider to slide longer distances along the lower side of the skateboard deck during sliding tricks and maneuvers.

A further aspect of the invention involves a method of making a high-strength skateboard deck including providing a plurality of wood veneers; applying an adhesive to the plurality of wood veneers; attaching the wood veneers together to form a plurality of skateboard deck blanks including an upper side and a lower side; and high-pressure press forming the skateboard deck blanks into a desired shape and simultaneously embossing at least one of the upper side and the lower side of the skateboard deck blanks.

DETAILED DESCRIPTION OF PREFERRED EMBODIMENTS

Figure 1:
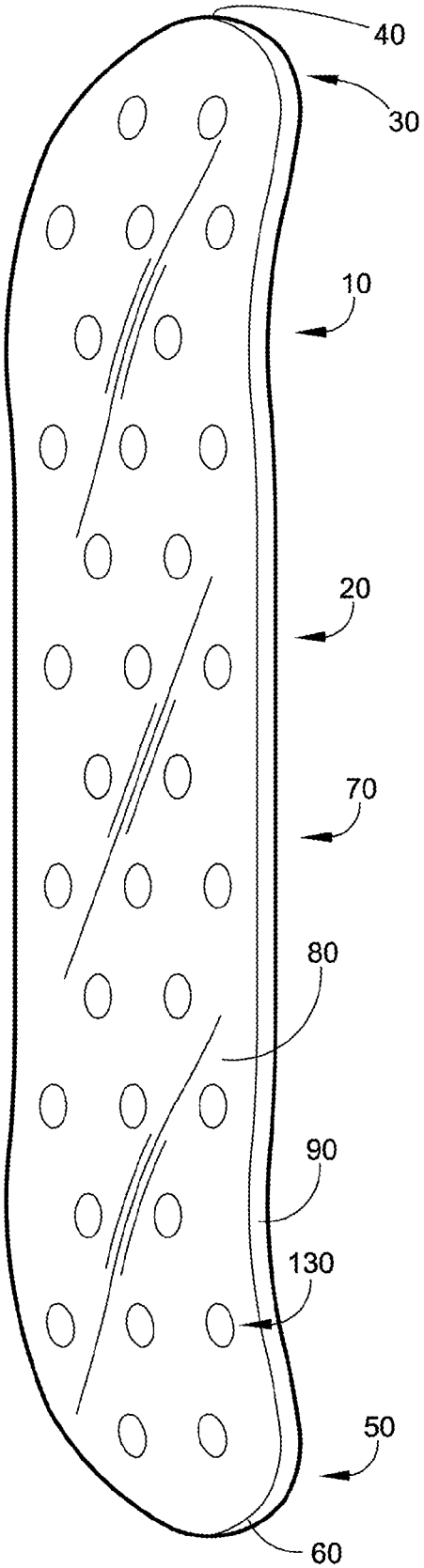
FIG. 1 is a bottom perspective view of an embodiment of a skateboard deck.
Figure 2:
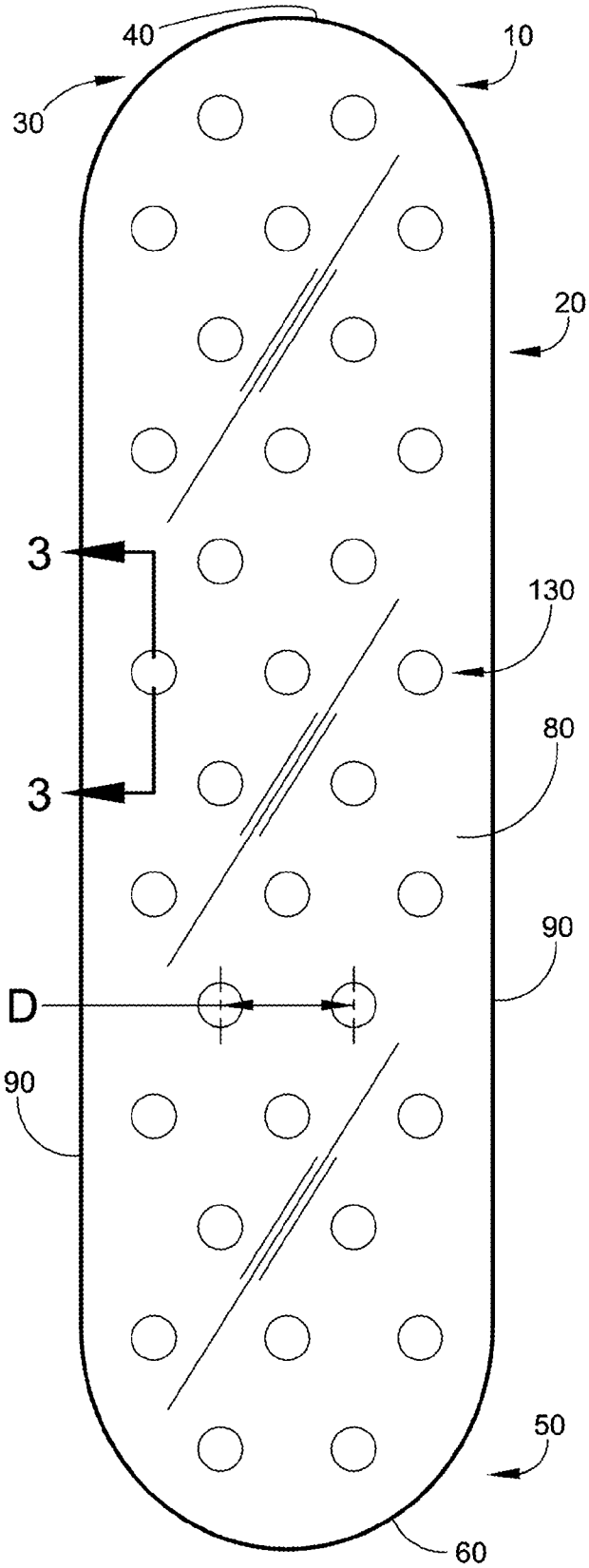
FIG. 2 is a bottom plan view of the skateboard deck illustrated in FIG. 1.
Figure 3:
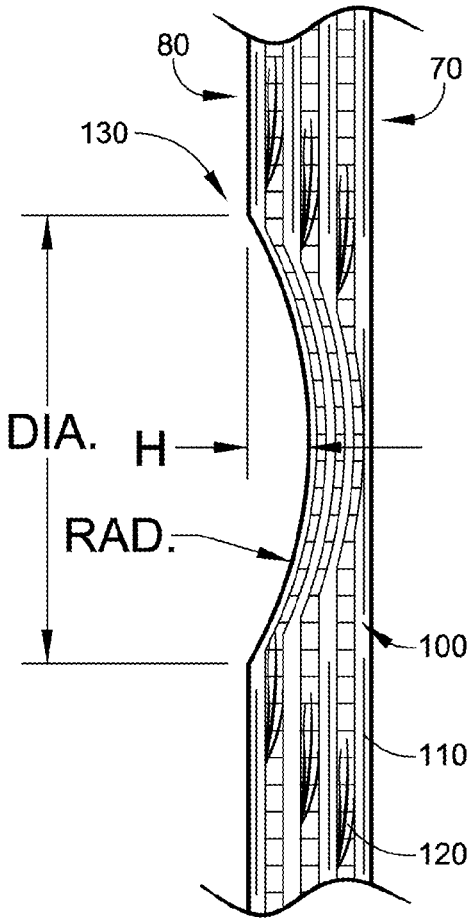
FIG. 3 is a cross-sectional view of the skateboard deck taken along lines 3-3 of FIG. 2.
Figure 4:
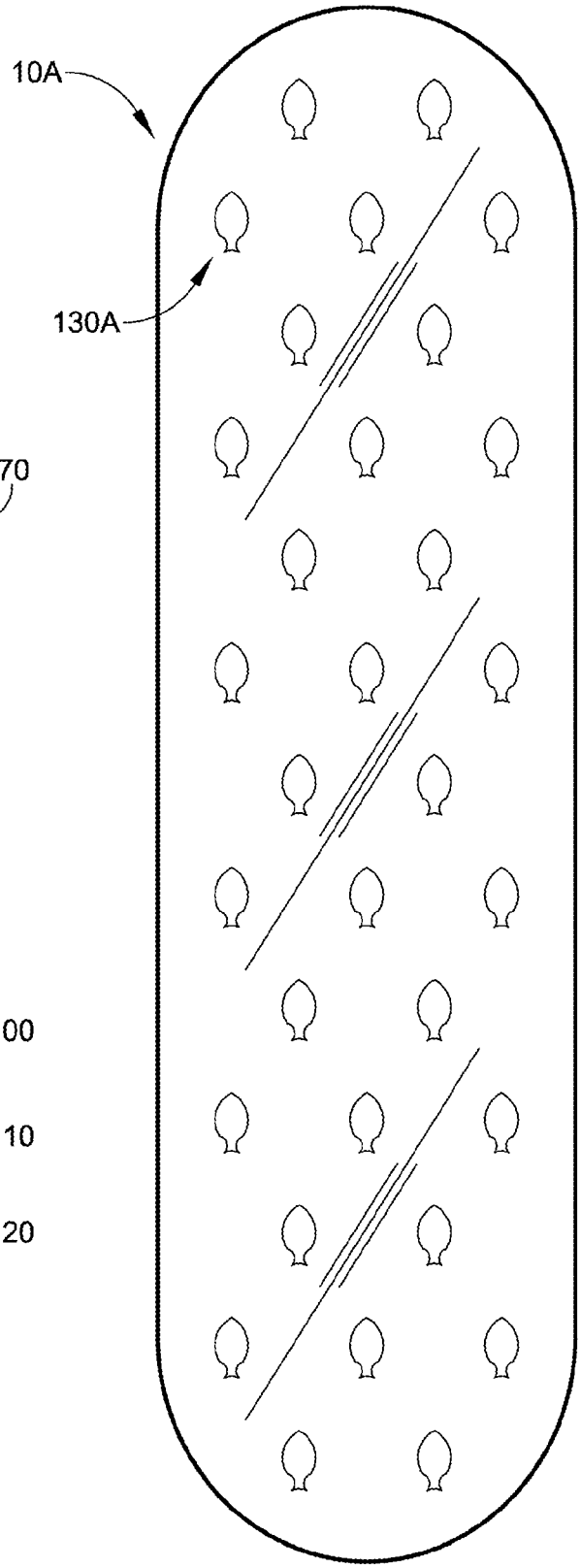
FIG. 4 is a bottom plan view of an alternative embodiment of a skateboard deck.

With reference to FIGS. 1-3, an embodiment of a skateboard deck 10 will be described. The skateboard deck 10 includes a substantially flat, elongated body 20, an angled head 30 having a curved end 40, an angled tail 50 having a curved end 60, an upper side or top 70, a lower side or bottom 80, and sides or rails 90. Although not shown, the skateboard deck 10 includes screw holes that receive threaded fasteners for fastening trucks to the lower side 80 of the skateboard deck 10. The trucks include wheels that rotate around axles via ball bearings.

With reference to FIG. 3, in the embodiment shown, the body 20 is made of seven veneers or layers 100 made of a standard hard maple wood that are stacked on top of each other and pressed together. In alternative embodiments, the body 20 is made of other numbers of veneers (e.g., six veneers, eight veneers, etc.), other types of wood, and/or other types of material(s). In a preferred embodiment, a heat-sensitive adhesive made of two-part epoxy impregnates the veneers 100 and holds the veneers 100 together. However, in an alternative embodiment, the adhesive is not a heat-sensitive adhesive. In still another embodiment, the adhesive is a frequency-sensitive adhesive.

The veneers 100 include a first veneer 110 with a grain running in a direction and an adjacent second veneer 120 with a grain running in a substantially perpendicular direction to the direction of the grains in the first veneer 110. The skateboard deck 10 includes the veneers 100 stacked in the following order (from the lower side 80 to the upper side 70) to make the following seven layers: 1) first veneer 110, 2) second veneer 120, 3) first veneer 110, 4) second veneer 120, 5) first veneer 110, 6) second veneer 120, 7) first veneer. In alternative embodiments, the veneers 100 are stacked in different configurations that that shown and described herein.

The upper side 70 includes an entirely smooth surface and the lower side 80 includes a smooth surface with a plurality of embossments 130 therein. As used herein, an "embossment" is a high-pressure, molded-in relief. In the areas of the embossments 130 (i.e., between the embossment and the opposite side of the skateboard deck 10) 130, the veneers 100 are compressed closer together compared to the areas where no embossments 130 exist in the skateboard deck 10.

Although the embossments 130 are described as being in the lower side 80 of the skateboard deck 10, in alternative embodiments, the embossments 130 are in the upper side 70 of the skateboard deck 10, or both the upper side 70 and lower side 80 of the skateboard deck 10.

In the embodiment shown, the embossments 130 are circular concave dimples having a depth or height H, a radius of curvature RAD, and a diameter DIA. The embossments 130 are located a distance D from each other. The distance D is the distance between the geometric centers of the embossments 130.

In a preferred embodiment, the embossments 130 have a height H of at least 1/24 inches. In a more preferred embodiment, the embossments 130 have a height H of at least 1/12 inches. In a most preferred embodiment, the embossments 130 have a height H of at least 1/8 inches.

In a preferred embodiment, the embossments 130 have a diameter DIA of at least 1/8 inches. In a more preferred embodiment, the embossments 130 have a diameter DIA of at least 1/6 inches. In a most preferred embodiment, the embossments 130 have a diameter DIA of at least 1/4 inches.

In a preferred embodiment, the embossments 130 have a distance D of at least 1/4 inches. In a more preferred embodiment, the embossments 130 have a distance D of at least 1/2 inches. In a most preferred embodiment, the embossments 130 have a distance D of at least 3/4 inches.

Although the embossments 130 are shown in FIGS. 1-3 as being circular dimples, in an alternative embodiment of a skateboard deck 10A, the embossments 130A have a different configuration such as, but not limited to, arrowhead-shaped, clover-shaped, diamond-shaped, and bee shaped. In a further embodiment, the embossments 130 have different configurations from each other (i.e., not all the embossments 130 have the same configuration).

Figure 5:
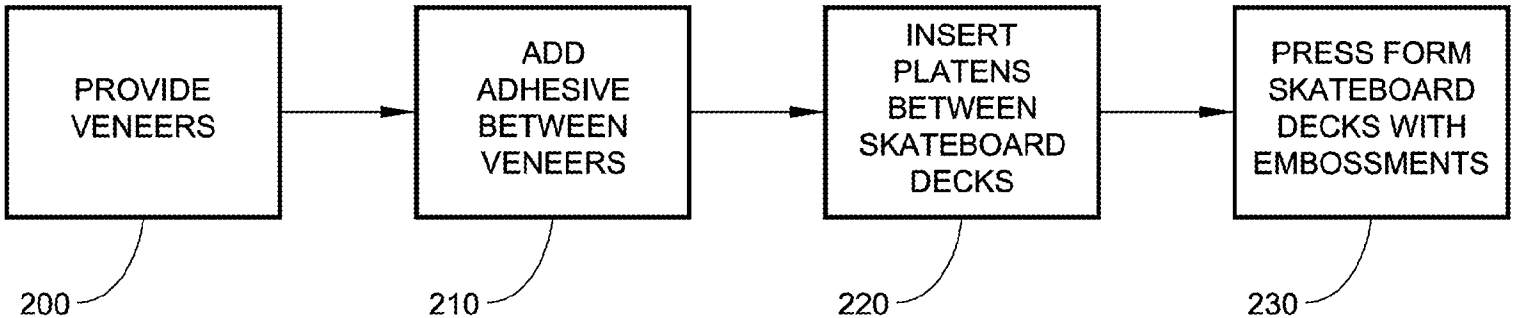
FIG. 5 is a flow chart of an exemplary method of making a skateboard deck.
Figure 6:
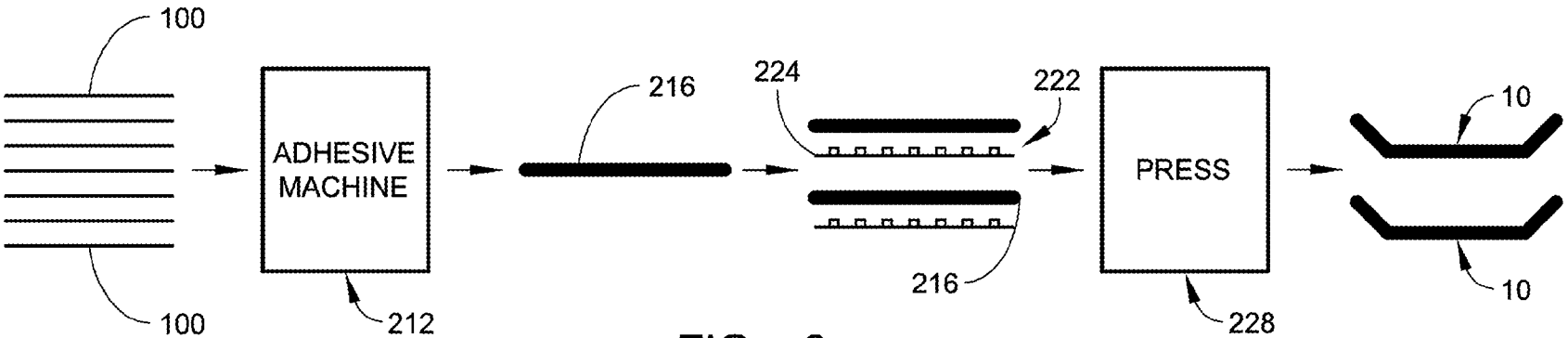
FIG. 6 is a schematic illustration of the exemplary method of making a skateboard deck.

With reference to FIGS. 5 and 6, an exemplary method of making the skateboard deck 10 will now be described. At step 200, the veneers 100 of standard hard maple are provided. As mentioned above, in alternative embodiments, the veneers 100 include other numbers of veneers (e.g., six veneers, eight veneers, etc.), other types of wood, and/or other types of material(s).

At step 210, an adhesive is added between veneers 100. The veneers 100 are run though a machine 212 for applying the adhesive. Then, the veneers 100 with added adhesive are stacked and oriented on top of each other as shown in FIG. 3 to form a substantially flat skateboard deck blank or preform 216. In a preferred embodiment, the adhesive is a heat-sensitive adhesive made of two-part epoxy that impregnates the veneers 100 and holds the veneers 100 together. However, in an alternative embodiment, the adhesive is not a heat-sensitive adhesive. In still another embodiment, the adhesive is a frequency-sensitive adhesive.

In an embodiment where embossments 130 are added to the lower side 80 of the skateboard deck 10, at step 220, a platen 222 is inserted between two skateboard deck blanks 216 and below the bottom blank 216. In the embodiment shown, each platen 222 is made of a thermo ABS material, and includes a smooth flat lower side surface and a flat upper side surface with reverse embossments 224 protruding therefrom. In an alternative embodiment, the platen 222 is an aluminum plate (e.g., aluminum diamond plate with diamond-shaped reverse embossments). The reverse embossments 224 are protrusions with configurations having mirror images of the embossments 130. The platens 222 have a length and a width substantially similar to the length and the width of the skateboard deck blanks 216, which are generally rectangular and have a length and the width substantially similar to the length and width of the skateboard decks 10 shown in FIGS. 1, 2. In an embodiment of the manufacturing method, the skateboard deck blanks 216 and platens 222 are stacked as follows: 1) first, a platen 222 (with the smooth lower side surface facing down and reverse embossments 224 facing upward) is laid down, 2) then, a first skateboard deck blank 216 is laid on top of the first platen 222, 3) then, a second platen 222 (with the smooth lower side surface facing down and reverse embossments 224 facing upward) is laid down on top of the first skateboard deck blank 216; 4) then, a second skateboard deck blank 216 is laid on top of the second platen 222. In alternative embodiments, other numbers of platens 222 and/or blanks 216 are provided.

In alternative embodiment, where embossments 130 are added to the upper side 70 of the skateboard deck 10, the reverse embossments 224 protrude or face downward from a lower side of the platen 222 and an upper side of the platen 222 has a smooth upper side surface. The platens 222 would be stacked in an opposite manner to that described above.

In a further embodiment, where embossments 130 are added to the upper side 70 and the lower side 80 of the skateboard deck 10, the reverse embossments 224 protrude downward from a lower side of the platen 222 and protrude upward from an upper side of the platen 222. The platens 222 and skateboard deck blanks 216 would be stacked so that a platen 222 is on each side of a skateboard deck blank 216.

The skateboard deck blanks 216 and platens are inserted into a mold of a high-pressure press 228, and, at step 230, the skateboard deck blanks 216 and platens are pressed together under high pressure so that the embossments 130 are embossed into the lower sides 80 of the skateboard deck blanks 216, the skateboard deck blanks 216 are shaped, and the adhesive impregnates the veneers 100 and cures, forming a support matrix to hold the veneers 100 together. As indicated above, in alternative embodiments, the skateboard deck blanks 216 are cold pressed, thermally pressed or hot pressed, and frequency pressed.

In the cold press embodiment, a regular adhesive normally used for cold pressing skateboard deck blanks 216 is used, and the skateboard deck blanks 216 are pressed and embossed at room temperature in the manner described above. The press is not raised to an elevated temperature as in the hot/thermal press method.

In the embodiment where the adhesive is a heat-sensitive adhesive and the press 228 is a thermal/hot press, the skateboard deck blanks 216 and platens are inserted into a mold of the high-pressure thermal press 228, and, at step 230, the skateboard deck blanks 216 and platens are pressed together under high pressure and elevated temperature conditions (compared to room temperature, cold pressing) so that the embossments 130 are embossed into the lower sides 80 of the skateboard deck blanks 216, the skateboard deck blanks 216 are shaped, and the heat-sensitive adhesive impregnates the veneers 100 and cures, forming a support matrix to hold the veneers 100 together.

In the embodiment where the skateboard deck blanks 216 are frequency pressed, the skateboard deck blanks 216 and platens are inserted into a mold of the high-pressure frequency press 228, and, at step 230, the skateboard deck blanks 216 and platens are pressed together under high pressure and high frequency conditions (e.g., RF energy is applied to skateboard deck blanks 216 and frequency-sensitive adhesive) so that the embossments 130 are embossed into the lower sides 80 of the skateboard deck blanks 216, the skateboard deck blanks 216 are shaped, and the frequency-sensitive adhesive impregnates the veneers 100 and cures, forming a support matrix to hold the veneers 100 together.

The high-pressure press 228 is opened, and the skateboard deck blanks 216 and platens 222 are removed, and separated. The resulting skateboard deck blanks 216 are then cut into the desired shape shown in FIGS. 1, 2, and finish processing is performed to form the skateboard decks 10.

The above method of manufacturing the skateboard deck 10 creates the embossments 130 on the lower side 80 and/or upper side 70 of the skateboard deck 10, which add to the strength of the skateboard deck 10. The embossments 130 created under high-pressure conditions have a greater concentration or density of veneers 100 in a thinner area of the skateboard deck 10 compared to the non-embossed section(s) of the skateboard deck 10. These greater density veneer sections where the embossments 130 are located increase the strength of the skateboard deck 10 in these sections and in the overall skateboard deck 10. As a result, the skateboard deck 10 maintains its rigidity longer than boards in the past, reduces fatigue in the skateboard deck, and makes the skateboard deck better suited for tricks, jumps, or other skateboarding conditions where the skateboard deck 10 is subject to high-stress conditions over time.

The embossments 130 in the lower side 80 create less flat surface area in the lower side 80 and reduce the coefficient of friction in the lower side 80 compared to a lower side without the embossments 130. This allows a rider to slide longer distances along the lower side 80 of the skateboard deck 10 on rails or edges of objects during sliding tricks and maneuvers than was possible with skateboard decks in the past.

It is believed that the embossments 130 also create an aerodynamic effect that helps provide lift and/or reduces aerodynamic drag in the skateboard deck 10. This lift and/or reduced drag allows a rider to slide longer distances and/or perform longer skateboard tricks and maneuvers than was possible with skateboard decks in the past.

The above method of manufacturing the skateboard deck 10 also provides a quicker manufacturing method for forming multi skateboard deck blanks 216 made of multiple-layered wood veneers. Using the heat-sensitive adhesive and high-pressure thermal press allows the temperature-sensitive adhesive to more quickly and completely impregnate the veneers 100, and allows the temperature-sensitive adhesive to cure more quickly. Thus, this manufacturing method allows more skateboard decks 10 to be produced in less time.

Utilizing the platens 224 with the skateboard deck blanks 216 during the high-pressure press forming step provides a quick, easy way to emboss the skateboard deck blanks 216 without a separate embossment step or procedure.

Utilizing the platens 224 with the skateboard deck blanks 216 during the high-pressure press forming step also provides a quick, easy way to separate the skateboard deck blanks 216 after the high-pressure press forming step because the platens 224 also function as effective separators to separate the skateboard deck blanks 216. In the past, adhesive, especially adhesive running along the edges of skateboard deck blanks 216, would cause skateboard deck blanks 216 to stick together after the high-pressure press forming step. This would make it difficult to separate the skateboard deck blanks 216 from each other.

While the particular devices and methods herein shown and described in detail are fully capable of attaining the above described objects of this invention, it is to be understood that the description and drawings presented herein represent presently preferred embodiments of the invention and are therefore representative of the subject matter which is broadly contemplated by the present invention. It is further understood that the scope of the present invention fully encompasses other embodiments that may become obvious to those skilled in the art having the benefit of this disclosure and that the scope of the present invention is accordingly limited by nothing other than the appended claims.

What is claimed is:

1. A high-strength skateboard deck, comprising: an elongated body having a plurality of wood veneers held together by a two-part heat-sensitive adhesive and opposite ends, opposite sides, an upper side and a lower side, the lower side including a plurality of embossments therein, improving the strength in the skateboard deck, reducing fatigue in the skateboard deck, and reducing the coefficient of friction of the lower side of the skateboard deck.

2. The high-strength skateboard deck of claim 1, wherein the plurality of wood veneers are maple veneers.

3. The high-strength skateboard deck of claim 1, wherein each wood veneer of the plurality of wood veneers has a grain direction, and adjacent veneers include grain directions running in different directions.

4. The high-strength skateboard deck of claim 1, wherein each wood veneer of the plurality of wood veneers has a grain direction, and adjacent veneers include grain directions running in substantially perpendicular directions.

5. The high-strength skateboard deck of claim 1, wherein the embossments are one of dimples and a different configuration from dimples.

6. The high-strength skateboard deck of claim 1, wherein the high-strength skateboard deck includes a periphery and the embossments are in a portion of the skateboard deck central to the periphery and do not contact the periphery.

7. The high-strength skateboard deck of claim 1, wherein the embossments are in both the lower side and upper side.

8. A high-strength skateboard deck, comprising: an elongated body having a plurality of wood veneers held together by a two-part heat-sensitive adhesive and opposite ends, opposite sides, an upper side and a lower side, the lower side including a plurality of embossments therein, improving the strength in the skateboard deck, reducing fatigue in the skateboard deck, and reducing the coefficient of friction of the lower side of the skateboard deck, wherein the embossments have a configuration different than a dimple configuration.

9. The high-strength skateboard deck of claim 8, wherein the plurality of wood veneers are maple veneers.

10. The high-strength skateboard deck of claim 8, wherein each wood veneer of the plurality of wood veneers has a grain direction, and adjacent veneers include grain directions running in different directions.

11. The high-strength skateboard deck of claim 8, wherein each wood veneer of the plurality of wood veneers has a grain direction, and adjacent veneers include grain directions running in substantially perpendicular directions.

12. The high-strength skateboard deck of claim 8, wherein the high-strength skateboard deck includes a periphery and the embossments are in a portion of the skateboard deck central to the periphery and do not contact the periphery.

13. The high-strength skateboard deck of claim 8, wherein the embossments are in both the lower side and upper side.

14. A high-strength skateboard deck, comprising: an elongated body having a plurality of wood veneers held together by a two-part heat-sensitive adhesive and opposite ends, opposite sides, an upper side and a lower side, the lower side including a plurality of embossments therein, improving the strength in the skateboard deck, reducing fatigue in the skateboard deck, and reducing the coefficient of friction of the lower side of the skateboard deck, wherein the high-strength skateboard deck includes a periphery and the embossments are in a portion of the skateboard deck central to the periphery and do not contact the periphery.

15. The high-strength skateboard deck of claim 14, wherein the plurality of wood veneers are maple veneers.

16. The high-strength skateboard deck of claim 14, wherein each wood veneer of the plurality of wood veneers has a grain direction, and adjacent veneers include grain directions running in different directions.

17. The high-strength skateboard deck of claim 14, wherein each wood veneer of the plurality of wood veneers has a grain direction, and adjacent veneers include grain directions running in substantially perpendicular directions.

18. The high-strength skateboard deck of claim 14, wherein the embossments are in both the lower side and upper side.

* * * * *